US005382060A

United States Patent [19]

O'Toole et al.

[11] Patent Number: 5,382,060

[45] Date of Patent: Jan. 17, 1995

[54] LATCHING APPARATUS FOR DOUBLE DOORS

[75] Inventors: James F. O'Toole; William M. Martz, both of Rockford, Ill.; Todd W. Bruchu, Lake Elmo; Scott R. Beske, Stillwater, both of Minn.

[73] Assignee: Amerock Corporation, Rockford, Ill.

[21] Appl. No.: 2,956

[22] Filed: Jan. 11, 1993

[51] Int. Cl.[6] ..... E05C 3/16

[52] U.S. Cl. ..... 292/46; 292/336.3; 292/DIG. 46; 292/DIG. 62

[58] Field of Search ..... 292/336.3, DIG. 21, 292/DIG. 30, DIG. 41, DIG. 46, DIG. 62, 150, 36, 169.14

[56] References Cited

U.S. PATENT DOCUMENTS

| | | | |
|---|---|---|---|
| 2,202,916 | 6/1940 | Mussa | 292/177 |
| 3,582,120 | 7/1971 | Doerr | 292/36 |
| 3,953,061 | 4/1976 | Hansen et al. | 292/36 |
| 4,099,953 | 7/1978 | Gwozdz | 292/DIG. 21 X |
| 4,470,277 | 9/1984 | Uyeda | 292/36 |
| 4,518,178 | 5/1985 | Bengtsson | 292/8 |
| 4,548,432 | 10/1985 | Bengtsson | 292/8 |
| 5,197,771 | 3/1993 | Kaup et al. | 292/DIG. 21 X |

FOREIGN PATENT DOCUMENTS

| | | |
|---|---|---|
| 2914377 | 10/1980 | Germany . |
| 127972 | 6/1919 | United Kingdom . |

OTHER PUBLICATIONS

Two sheets of drawings by AB Fixfabriken, Goteberg, Sweden, one sheet being dated Jun. 6, 1990 and the other being dated Jun. 10, 1990.

*Primary Examiner*—Rodney M. Lindsey

*Attorney, Agent, or Firm*—Leydig, Voit & Mayer, Ltd.

[57] ABSTRACT

Latching apparatus for first and second adjacent swinging doors prevents locking of the first door unless the second door is latched and prevents unlatching of the second door unless the first door is open.

4 Claims, 5 Drawing Sheets

FIG. 1
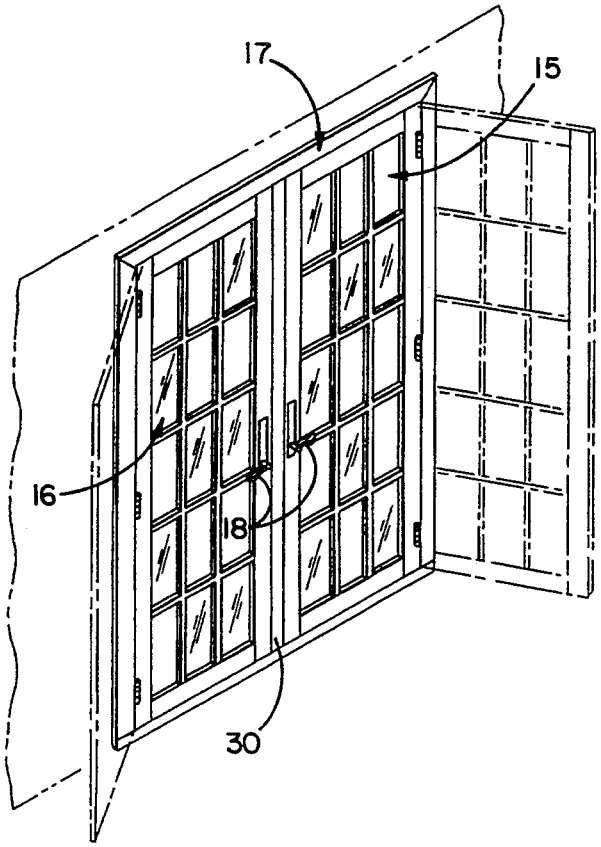
FIG. 3
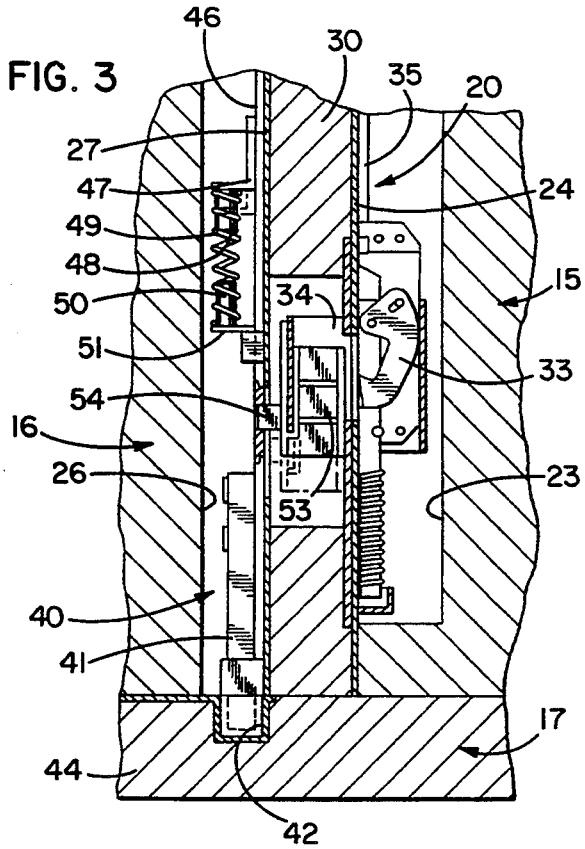
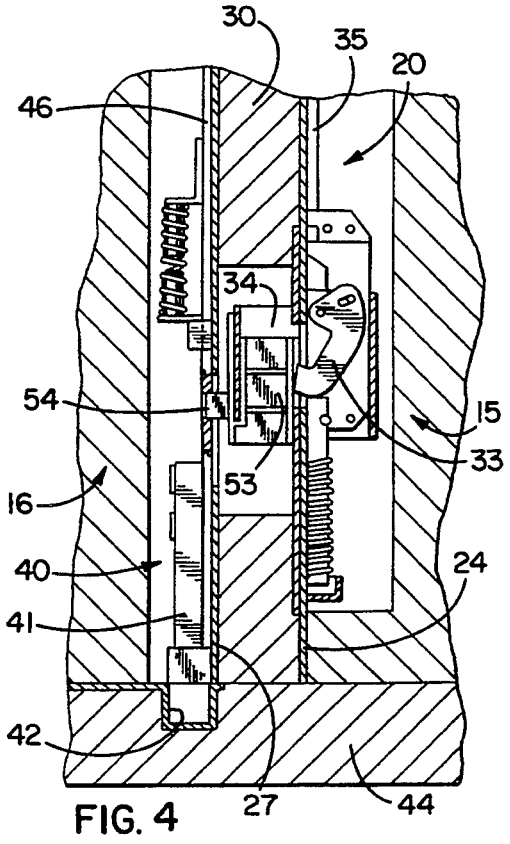
FIG. 4

LATCHING APPARATUS FOR DOUBLE DOORS

BACKGROUND OF THE INVENTION

This invention relates to latching apparatus for use with first and second adjacent doors each adapted for independent movement between open and closed positions. Doors with which the latching apparatus is particularly adapted for use are so-called French doors usually located either at the front or rear entrance of a home or other building and adapted to be swung between their open and closed positions.

In a double door system of this type, one of the doors typically is referred to as an active door since that door is the one which is most frequently opened to permit passage to and from the home. The other door is conventionally called a passive door. It usually is opened only when large furnishings or the like are moved into and out of the home or when it is desired to provide maximum ventilation or maximum visual exposure through the doors.

In some installations, the passive door is adapted to be held releasably in its closed position by upper and lower latch elements which coact with the top header and the lower sill of the door frame. A latch operating mechanism is associated with the passive door and may be manually actuated from inside the home to withdraw the latch elements from the header and sill and permit opening of the passive door.

The active door is adapted to be held in its closed position by one or more latch elements which latch into an astragal on the upright free edge of the passive door. In one type of active door, the latch elements comprise upper and lower hook latches, a center spring latch and a center deadbolt. The active door is adapted to be locked by throwing the deadbolt either with a turn knob from inside of the home or with a key-operated mechanism from the outside.

Because the active door is latched and locked only to the astragal of the passive door, the security of the door system is dependent upon the security with which the passive door is latched. If the passive door is left unlatched, an intruder may more easily gain access to the home even though the active door is latched and locked to the passive door. Also, strong winds can damage the door system due to the fact that the passive door is not latched to the header and sill of the door frame.

In an effort to overcome the problem of the passive door being left unlatched when the active door is locked, it has been proposed to provide a latching system which prevents the active door from being locked if the passive door is closed but unlatched. With this arrangement, the homeowner—upon attempting and failing to lock the active door—is warned that the passive door is unlatched and must take steps to latch that door before he/she can lock the active door. Such an arrangement does not, however, prevent the homeowner from unlatching and attempting to open the passive door while the active door is either latched or latched and locked to the astragal of the passive door. If such an attempt is made, damage can result to the locking system and/or the doors.

SUMMARY OF THE INVENTION

The general aim of the present invention is to provide new and improved latching apparatus of the above general type which prevents the passive door from being unlatched and opened unless the active door has first been opened and is free of the passive door. In this way, there is no danger of the latching system or doors being damaged if an attempt is made to open the passive door while the latter is still connected with the active door by the latching system at the astragal.

A more detailed object of the invention is to achieve the foregoing by providing a passive door latch having a sensor which detects the presence or absence of the active door in its closed position. Upon detecting that the active door is closed, the sensor prevents the passive door latching elements from being moved to their unlatched positions and thus prevents opening of the passive door. Upon detecting that the active door is open, the sensor permits the passive door latch to operate in a normal manner and effect unlatching of its latch elements.

Another object is to provide a passive door latch which prevents unlatching of the passive door if the active door is closed and, in addition, prevents locking of the active door if the passive door is left unlatched.

The invention also resides in the provision of a relatively simple and inexpensive lost motion mechanism in the passive door latch to enable the functions set forth in the preceding object to be achieved.

These and other objects and advantages of the invention will become more apparent from the following detailed description when taken in conjunction with the accompanying drawings.

BRIEF DESCRIPTION OF THE DRAWINGS

FIG. 1 is a perspective view of typical double doors equipped with new and improved latching apparatus incorporating the unique features of the present invention.

FIG. 3 is an enlarged view of certain components illustrated in FIG. 1 and shows one latching element of each door in an unlatched position.

FIG. 4 is a view similar to FIG. 3 but shows the latching element of the active door being blocked against movement to its latched position.

DETAILED DESCRIPTION OF THE PREFERRED EMBODIMENT

Figure 2:
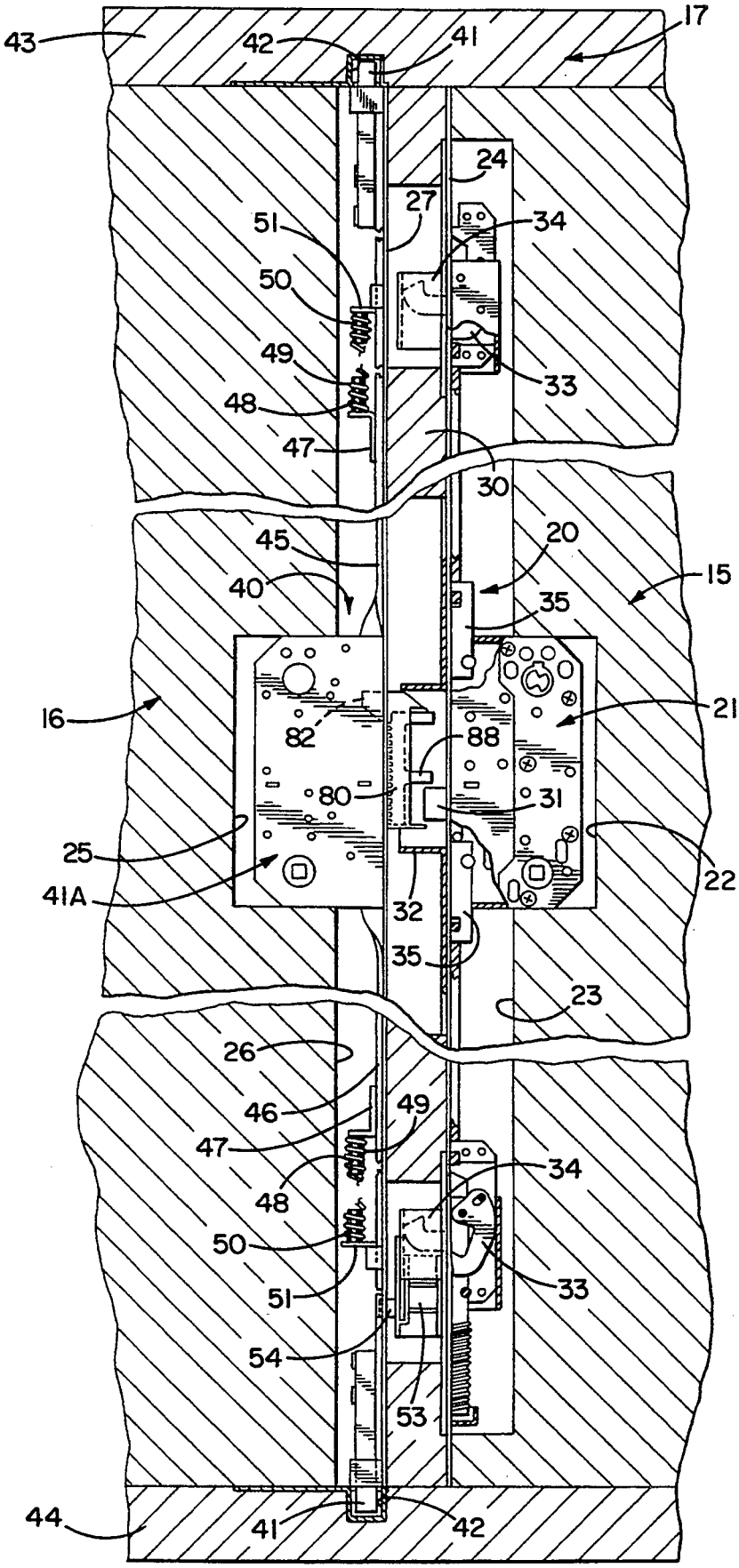
FIG. 2 is an enlarged fragmentary cross-section taken vertically through the doors of FIG. 1 and showing the latching apparatus.

For purposes of illustration, the invention has been shown in the drawings as embodied in latching apparatus for use with first and second adjacent doors 15 and 16 which are supported within a door frame 17 for independent movement between open and closed positions. In this particular instance, the doors are wood swinging doors (i.e., French doors) and usually are used at the main front or rear entrance of a home or other building. A manual operating handle or lever 18 is located on the inner side of the free edge portion of each door about midway along the height thereof and may be swung downwardly in order to unlatch and open the door.

The door 15 is commonly called an active door while the door 16 is commonly called a passive door. The active door 15 is the one which is opened most frequently for normal entry and exit. The passive door 16 also may be opened occasionally to accommodate large items of furniture, to increase ventilation in the building or to enable an unobscured view to the outside.

As shown most clearly in FIG. 2, the active door 15 includes a latching and locking mechanism which has been designated generally by the reference numeral 20. The latching and locking mechanism of the active door is of a conventional and well known construction and will be described only in sufficient detail to enable an understanding of the present invention.

Briefly, the latching and locking mechanism 20 includes an actuating unit 21 (FIG. 2) which is received within a relatively deep mortised pocket 22 in the free edge portion of the active door 15 about midway along the height thereof. Other components of the mechanism 20 are received in a shallower mortise 23 opening out of the free edge of the active door and terminating just short of the upper and lower ends of that door. A face plate 24 is secured to the free edge of the active door and closes up the mortise 23. For a purpose to be explained subsequently, a relatively deep mortised pocket 25 similar to the pocket 22 is formed in the free edge portion of the passive door 16 and is located at the same elevation as the pocket 22. In addition, a shallower mortise 26 opens out of the free edge of the passive door and extends throughout the full height of the passive door, the mortise 26 being closed up by a face plate 27. Attached to and extending along the face plate 27 is a wood astragal 30 which swings with the passive door. When both doors are closed, the free edge of the astragal lies closely adjacent the face plate 24 of the active door 15.

Associated with the actuating unit 21 of the active door latching and locking mechanism 20 is a conventional spring-biased latching element 31 (FIG. 2). When both doors 15 and 16 are closed, the latching element 31 normally projects into a receiver housing 32 in the astragal 30 and coacts with a strike (not shown) in the housing to hold the active door latched in a closed position. When the operating lever 18 of the active door 15 is swung downwardly, the latching element 31 releases the strike and is retracted out of the housing 32 so as to permit opening of the active door. As the active door is closed, the latching element 31 is cammed toward its retracted position and then automatically springs into the housing 32 in a conventional manner.

The latching and locking mechanism 20 of the active door 15 also includes upper and lower latching elements 33 (FIG. 2) which herein generally are in the form of hooks adapted to be pivoted between unlatched positions shown in full lines in FIG. 2 and latched positions shown in phantom. When the latching hooks 33 are thrown to their latched positions, they enter receiver housings 34 in the upper and lower end portions of the astragal 30 and coact with strikes (not shown) in the receiver housings to latch the upper and lower end portions of the active door to the astragal.

Linkages 35 (FIG. 2) extend from the actuating unit 21 to the upper and lower latch hooks 33. When the operating lever 18 of the active door 15 is pivoted upwardly, the linkages normally throw the hooks 33 to their latched positions and hold the hooks in such positions when the operating lever is allowed to return downwardly to its normal position. When the operating lever is pivoted downwardly to retract the spring latch 31, the hooks 33 are pivoted to their unlatched positions by the linkages 35.

Figure 5:
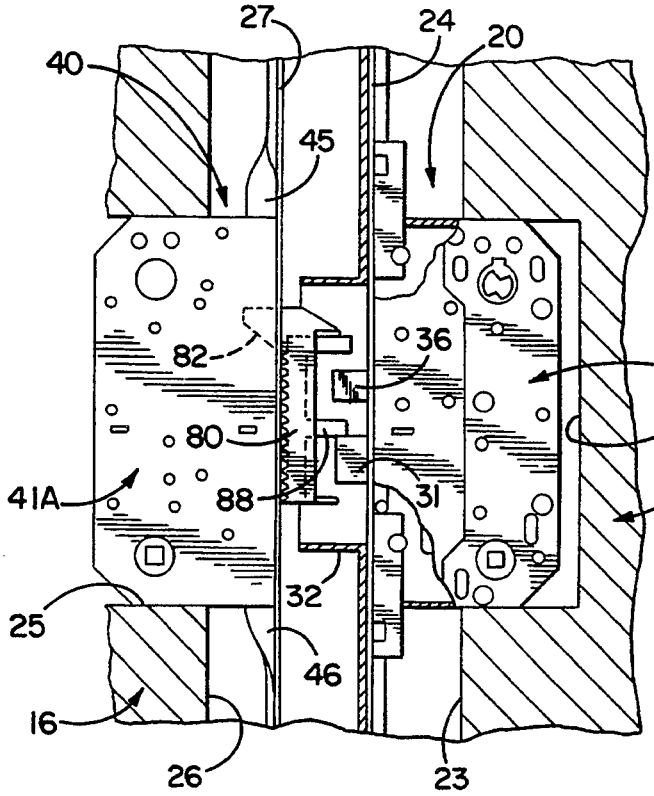
FIG. 5 is an enlarged view of the center portion of the latching apparatus illustrated in FIG. 2, the view showing the active door closed and showing an attempt being made to unlatch the passive door.

The latching and locking mechanism 20 of the active door 15 is completed by a deadbolt 36 (FIG. 5) which is shown in its locked position in FIG. 5. The deadbolt is adapted to be thrown between its locked and unlocked positions either by turning a knob (not shown) located just above the operating lever 18 of the active door or by actuating a key-operated mechanism from the outer side of the door. When the deadbolt is in its locked position, it projects into the housing 32 and coacts with a strike (not shown) to securely lock the active door in its closed position. In passing, it should be noted that the actuating unit 21 prevents the deadbolt from being thrown to its locked position unless the hook latches 33 have first been moved to their latched positions.

The passive door 16 includes a latching mechanism designated generally by the reference numeral 40, the mechanism 40 having an actuating unit 41A received in the mortised pocket 25 of the passive door. The latching mechanism 40 includes upper and lower latch elements 41 (FIG. 2) adapted to be selectively projected into and retracted from receiver sockets 42 located in the header 43 and the sill 44 of the door frame 17. When the latch elements 41 are located in latched positions in the sockets 42 as shown in FIG. 2, they latch the passive door 16 to the header 43 and the sill 44 and thereby prevent opening of the door. FIG. 4 shows the lower latch element 41 retracted upwardly from the socket 42 and located in an unlatched position so as to permit opening of the passive door, the upper latch element 41 being latched and unlatched simultaneously with the lower latch element.

In order to shift the upper and lower latch elements 41 between their latched and unlatched positions, upper and lower actuating links 45 and 46 (FIG. 2) are connected between the latch elements and the actuating unit 41A. Each actuating link lies along the inboard side of the face plate 27 and is connected at one end to the respective latch element 41. A bracket 47 is connected to each actuating link and carries a vertical rod 48 which supports one end portion of a preloaded coiled compression spring 49. The other end portion of the spring is supported on a vertical rod 50 on a bracket 51 which, in turn, is connected rigidly to the face plate 27.

When the operating lever 18 of the passive door 16 is pivoted upwardly, the upper and lower actuating links 45 and 46 are moved upwardly and downwardly, respectively, in order to throw the latching elements 41 to their latched positions shown in FIG. 2. During such movement of the actuating links, the springs 49 are compressed and thus tend to urge the upper link downwardly while urging the lower link upwardly. As will be explained in more detail subsequently, the loaded springs help throw the latching elements 41 to their unlatched positions when the operating lever 18 of the passive door is pivoted downwardly to unlatch the door.

As is apparent from the foregoing, the active door 15 is latched and locked to the astragal 30 of the passive door 16 which, in turn, is latched to the header 43 and the sill 44 by the latching elements 41. If the homeowner neglects to latch the passive door, the integrity of the door system is placed in question. For example, a strong wind acting against the doors could push the unlatched passive door toward its open position and could result in damage to the astragal 30, the face plates 24 or 27, the spring latch 31, the hook latches 33 or the deadbolt 36. Also, if the passive door is left unlatched, an intruder can more easily gain access to the home by ramming in the doors.

Advantageously, means are provided for preventing the active door 15 from being locked if the passive door 16 is left unlatched. Herein, these means comprise a blocker 53 (FIGS. 2–4) associated with the receiver housing 34 of the lower hook latch 33 and adapted to be moved between active and inactive positions by the lower actuating link 46 of the passive door latching mechanism 40. The blocker comprises a vertically movable member which is connected rigidly to the lower actuating link 46 by a finger 54 extending between the blocker and the actuating link. In the illustration of FIG. 2 and in the phantom line illustration of FIG. 3, the lower latching element 41 of the passive door 16 is shown in its latched position and, when the lower latching element is in that position, the blocker 53 is located in a lowered inactive position in the lower receiving housing 34. When the blocker is located in its lowered inactive position, it is disposed below the path followed by the lower hook latch 33 as that latch is pivoted from its unlatched position to its latched position. Accordingly, if the passive door 16 is latched, the lower hook latch 33 is free to move to its latched position (shown in phantom in FIG. 2) in the lower receiving housing 34 when the operating lever 18 of the active door 15 is pivoted upwardly and acts on the hook latches through the linkages 35. Once the hook latches have been moved to their latched positions, the deadbolt 36 may be thrown to its locked position in order to lock the active door to the astragal 30 of the latched passive door.

When the passive door 16 is unlatched as shown in full lines in FIGS. 3 and 4, the lower actuating link 46 locates the blocker 53 in an upper active position in which the blocker covers the entrance to the lower receiver housing 34. If an attempt is made to move the hook latches 33 to their locked positions, the lower hook latch engages the blocker as shown in FIG. 4 and thus is prevented from moving into the lower receiver housing 34. With the lower hook latch blocked, the upper hook latch is prevented from being actuated to its latched position and thus neither hook latch is capable of latching the active door 15. Because the hook latches cannot be latched, the deadbolt 36 cannot be thrown to its locked position. Accordingly, upon being unable to latch the hook latches and being unable to lock the deadbolt, the homeowner is warned that the passive door is unlatched and will take steps to latch that door in order to enable locking of the active door.

If the homeowner tries to open the passive door 16 while the active door 15 is closed, there is a risk that damage could result to the astragal 30 and the spring latch 31 and possibly to the hook latches 33 and the deadbolt 36 when an attempt is made to pull the passive door open with the active door still being latched or latched and locked to the astragal. In accordance with the present invention, the latch actuating unit 41 of the passive door is constructed in such a manner that the passive door cannot be unlatched and opened if the active door is closed. As a result, potential damage is avoided since the passive door can be unlatched and opened only after the active door has been opened and is free of the astragal 30.

To explain the foregoing, reference is made to FIGS. 7–11 which show the primary components of the latch actuating unit 41A of the passive door 16. As illustrated, the unit 41A comprises a case or housing which has been designated in its entirety by the reference numeral 55. Rotatably supported in the housing is a spindle 57 which is adapted to be rotated by the operating lever 18 of the passive door 16. A crank 58 is connected rigidly to and projects radially from the spindle and is pivotally connected at 59 to the lower end of a link 60 whose upper end is pivotally connected at 61 to an actuator member or plate 62. That plate is supported to turn about a pivot 63 in the housing 55. Also supported to turn about the pivot 63 is a drive member or plate 65 which is disposed in face-to-face relation with the actuator plate 62. Links 66 and 67 are pivotally connected at 68 and 69, respectively, to the drive plate 65. The upper end of the link 66 is pivotally connected at 70 (FIG. 8) to the lower end of the actuating link 45 for the upper latching element 41 while the lower end of the link 67 is pivotally connected at 71 to the upper end of the actuating link 46 for the lower latching element 41.

Figure 7:
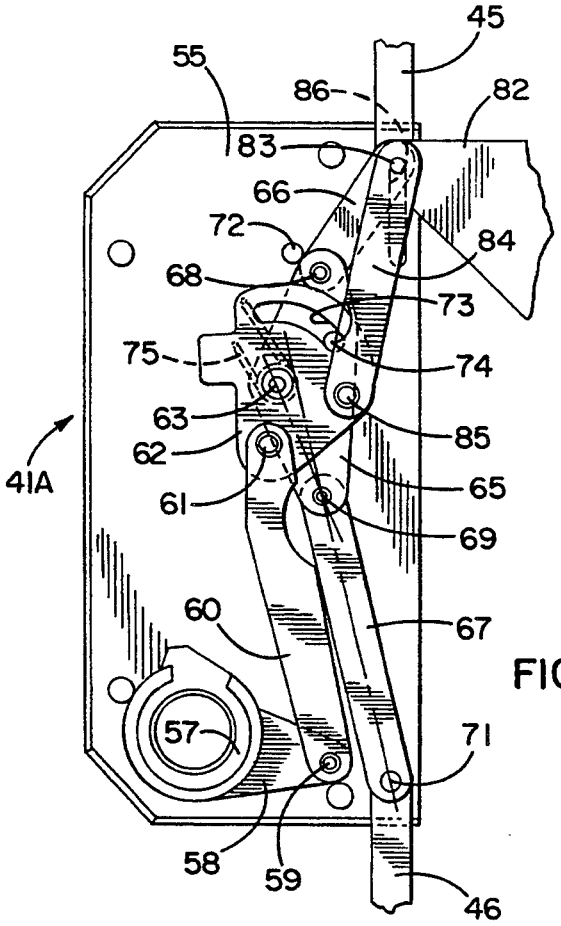
FIG. 7 is a front elevational view of the passive door latch actuating unit with part of the case of the unit removed for purposes of clarity, the latch actuating unit being shown in a latched condition.
Figure 8:
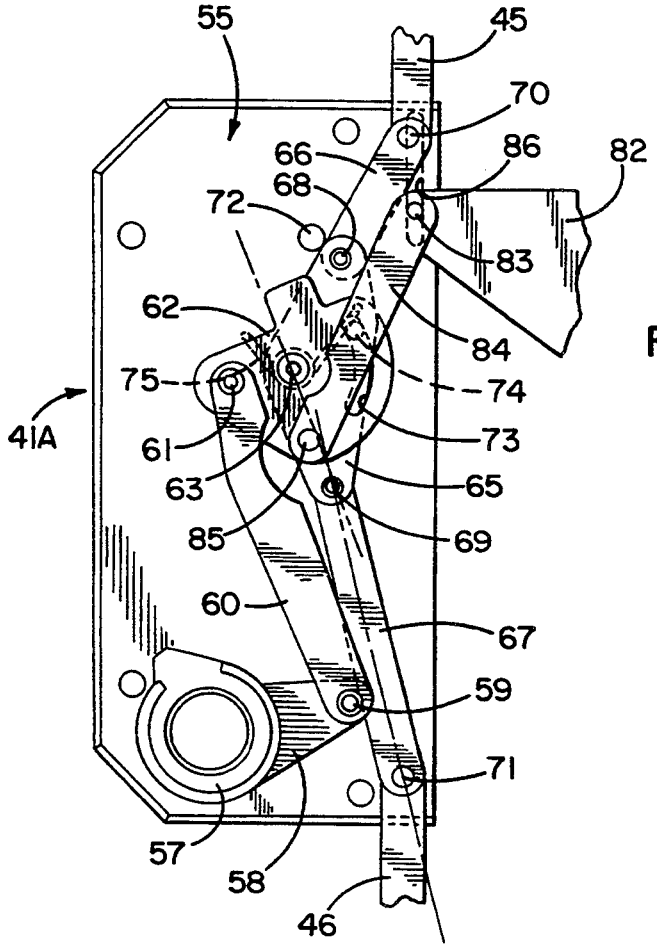
FIG. 8 is a view similar to FIG. 7 but shows the components of the latch actuating unit during an attempt to actuate the unit from a latched condition toward an unlatched condition.
Figure 9:
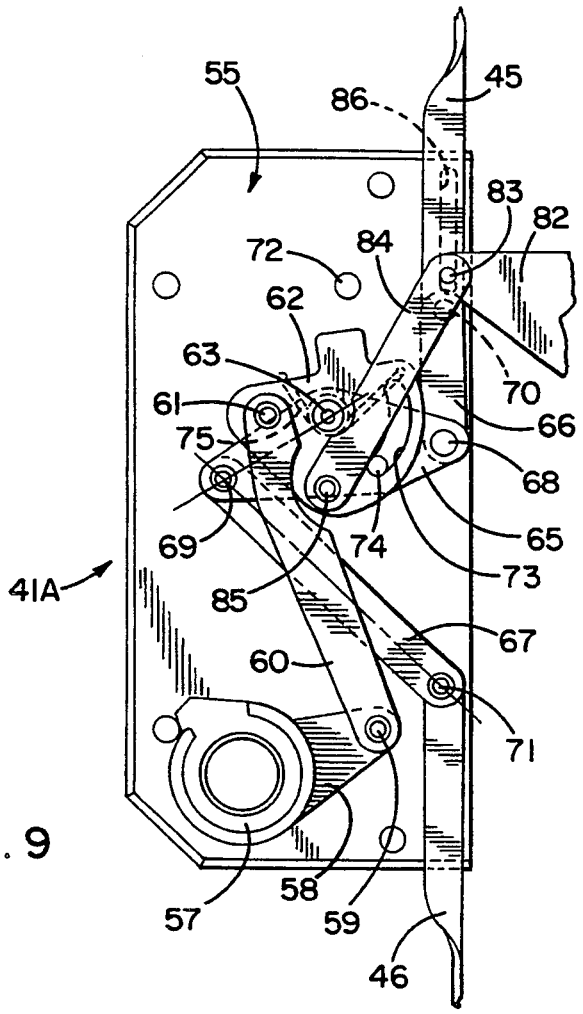
FIG. 9 also is a view similar to FIG. 8 but shows the latch actuating unit in an unlatched condition.
Figure 10:
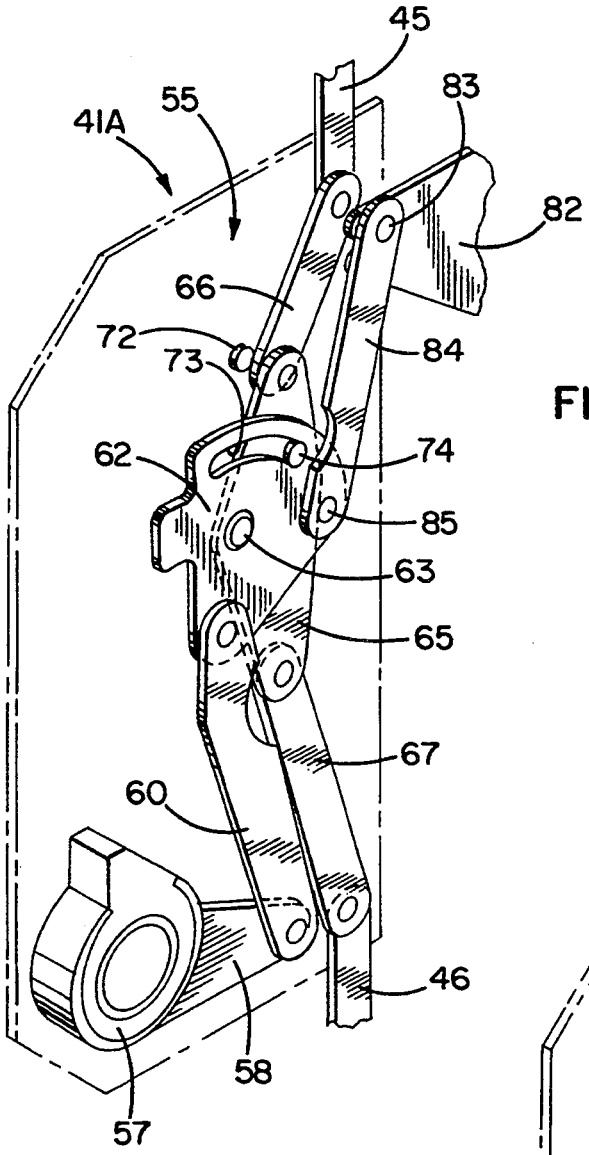
FIGS. 10 and 11 are perspective views showing the latch actuating unit in its latched and unlatched conditions, respectively.
Figure 11:
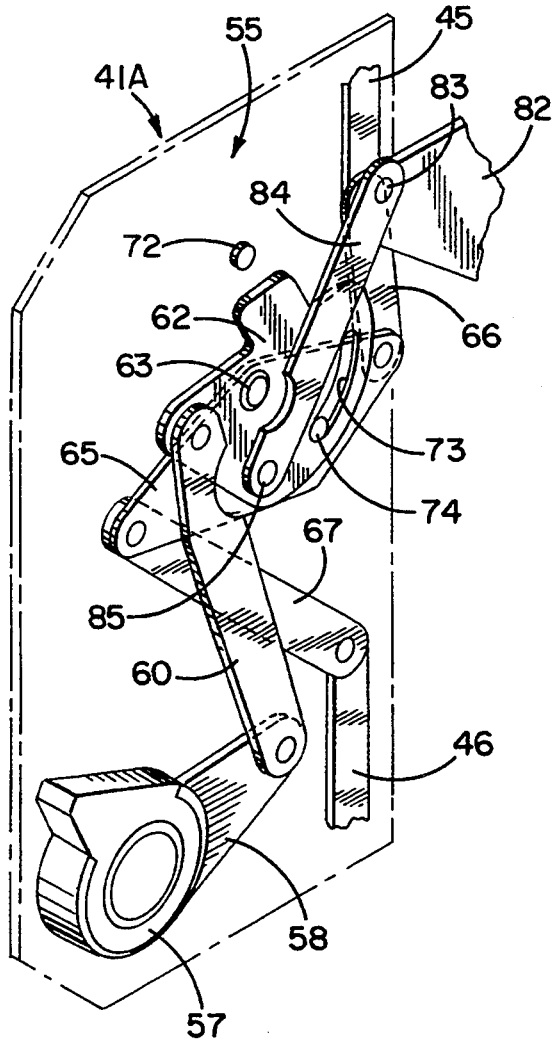

FIGS. 7 and 10 show the position of the driving plate 65 when the passive door 16 is latched and the latching elements 41 are projecting into the sockets 42. When the driving plate 65 is positioned as shown in FIGS. 7 and 10, the coil springs 49 are compressed to their maximum extent and act through the links 45 and 46 and the links 66 and 67 to exert forces tending to turn the driving plate in a counterclockwise direction about the pivot 63, the driving plate engaging a stop pin 72 (FIG. 7) in the housing 55 to limit the counterclockwise movement. As the driving plate 65 is pivoted clockwise from the latched position of FIGS. 7 and 10 to the unlatched position of FIGS. 9 and 11, the links 66 and 67 toggle overcenter with respect to the pivot 63 (compare FIGS. 7 and 9). As a result, the springs 49 thereafter tend to urge the driving plate 65 in a clockwise direction. The links 66 and 67 pull on the actuating links 45 and 46, respectively, to retract the upper and lower latching elements 41 to their unlatched positions and, in addition, the springs 49 expand to assist in such retraction.

In carrying out the invention, the driving plate 65 is turned from its latched position of FIG. 7 towards its unlatched position of FIG. 9 by the actuator plate 62, which is uniquely connected to the driving plate by a lost motion connection in order to prevent the actuator plate from turning the driving plate toward its unlatched position in the event the active door 15 is closed. Herein, the lost motion connection comprises a slot 73 and a pin 74 (FIGS. 7–10). The slot is formed through the actuator plate 62 and is curved arcuately about the axis of the pivot 63. The pin is attached rigidly to the driving plate 65 and projects into the slot. A torsion spring 75 encircles the pivot 63 and is connected between the actuator plate 62 and the housing 55 so as to urge the actuator plate in a counterclockwise direction and keep one end of the slot 73 bottomed snugly against the pin 74 when the components are in their latched position shown in FIG. 7.

Further in keeping with the invention, the actuator plate 65 drives a sensor 80 (FIGS. 2, 5 and 6) which is capable of detecting the presence or absence of the active door 15 in its closed position. In this instance, the sensor is in the form of a block which is guided for up and down sliding in the face plate 27 and adjacent the actuating unit 41. An ear 82 (FIGS. 2, 5 and 11) is joined rigidly to the sensor block 80 and is pivotally connected by a pin 83 (FIGS. 7–11) to the upper end of a link 84 whose lower end is pivotally connected at 85 to the actuator plate 62. The pin 83 is guided for up and down sliding by a slot 86 in the housing 55.

As shown in FIG. 5, a finger 88 is rigid with and projects horizontally from the sensor block 80 and is adapted to move upwardly and downwardly along a vertical path which intersects the position normally occupied by the spring latch 31 when the active door 15 is closed. If the active door is closed and the sensor block is moved downwardly, the sensing finger 88 engages and is stopped by the upper side of the spring latch 31 and thus stops further downward movement of the sensor block as shown in FIG. 5. If, however, the active door is open, the sensing finger 88 is capable of moving downwardly beyond the position otherwise occupied by the spring latch 31 and permits the sensor block 80 to move downwardly to the position shown in FIG. 6.

In order to explain the operation of the latching mechanism 40, assume that the active door 15 is closed and latched by the spring latch 31 and that the passive door 16 is also latched so that the components of the actuating unit 41A are positioned as shown in FIGS. 7 and 10. Under these conditions, the driving plate 65 is urged in a counterclockwise direction against the stop 72 by the coil springs 49 while the actuating plate 62 also is urged in a counterclockwise direction by the torsion spring 75 so as to keep one end (i.e., the right end) of the slot 73 bottomed against the pin 74. In addition, the sensing finger 88 of the sensor block 80 is spaced above the spring latch 31 as shown in FIG. 2.

When an attempt is made to unlatch the passive door 16 by turning the operating lever 18 of that door, the spindle 57 and the crank 58 are rotated counterclockwise (FIG. 7). The crank 58 acts through the link 60 to turn the actuating plate 62 clockwise about the pivot 63. During initial clockwise turning of the actuator plate, no motion is imparted to the driving plate 65 because the slot 73 in the actuator plate simply moves idly relative to the pin 74 of the driver plate. The actuator plate 62 does, however, act through the link 84 and the ear 82 to shift the sensor block 80 downwardly from the position shown in FIG. 2 toward the position shown in FIG. 5. Engagement of the sensing finger 88 of the block 80 with the upper side of the spring latch 31 stops further downward movement of the block and further clockwise turning of the actuator plate 62. The actuator plate 62 is stopped before the left or upper end of the slot 73 engages the pin 74 (see FIG. 8) and thus no motion is imparted to the driving plate 65. As a result, the passive door 16 cannot be unlatched. When the operating lever 18 of that door is released, the components simply return to the latched position of FIG. 7 by virtue of a spring (not shown) associated with the spindle 57.

Figure 6:
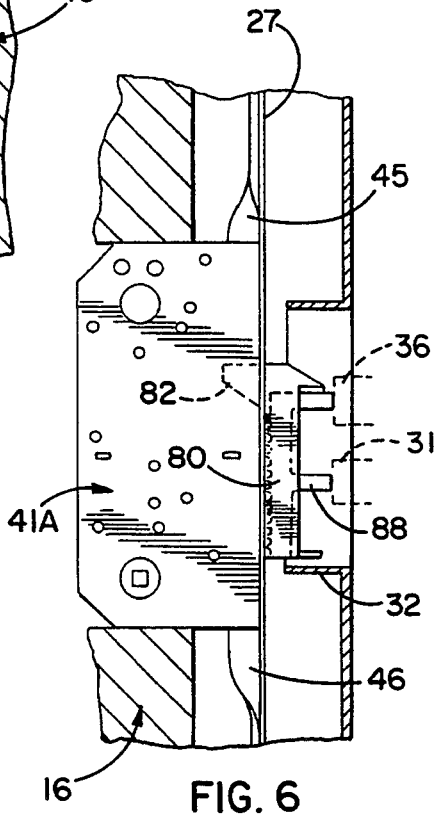
FIG. 6 is a fragmentary view similar to FIG. 5 but shows the active door open and shows the passive door being unlatched.

Now assume that the active door 15 is open so that the spring latch 31 no longer projects across the path of the sensing finger 88 (see FIG. 6). As before, counterclockwise turning of the spindle 57 and the crank 58 acts through the link 60 to turn the actuator plate 62 in a clockwise direction. And as before, the actuator plate initially turns with lost motion relative to the drive plate 65 and forces the sensor block 80 downwardly. In this case, however, the spring latch 31 is absent and thus the sensing finger 88 and the sensor block 80 are allowed to travel downwardly beyond the position of FIG. 5 and toward the position of FIG. 6. During such movement, the left or upper end of the slot 73 picks up the pin 74 and acts through the pin to turn the drive plate 65 clockwise. Once the drive plate 65 has been turned sufficiently far to cause the links 66 and 67 to toggle overcenter with respect to the pivot 63, the springs 49 act through the actuating links 45 and 46 and the links 66 and 67 to exert a clockwise biasing force on the drive plate and to cause that plate to pivot to the position shown in FIGS. 9 and 11. By virtue thereof, the latch elements 41 are retracted from the sockets 42 so as to unlatch the passive door and enable opening of that door.

Once the passive door 16 has been unlatched, the components are held in the position shown in FIG. 9 until such time as the operating lever 18 of the passive door is actuated to effect clockwise rotation of the spindle 57 and the crank 58. This produces counterclockwise rotation of the actuator plate 62 and, during initial counterclockwise rotation of that plate, the right or lower end of the slot 73 acts against the pin 74 to turn the drive plate 65 in a counterclockwise direction. Once the links 66 and 67 toggle reversely overcenter with respect to the pivot 63, the springs 49 exert a counterclockwise moment on the drive plate and cause that plate to pivot to its position of FIG. 7 and against the stop 72. Final clockwise turning of the spindle 57 and the crank 58 causes the actuator plate 62 to pivot back to the latched position of FIG. 7 with the slot 73 traveling idly past the pin 74 during such pivoting.

From the foregoing, it will be apparent that the present invention brings to the art a unique latching mechanism 40 which not only prevents locking of the active door 15 unless the passive door 16 is latched but which also prevents the passive door from being unlatched unless the active door is open. The latter safety function is achieved in a relatively inexpensive manner through the provision of the actuator plate 62; the lost motion connection 73, 74; the link 84 and the sensor block 80.

We claim:

1. Apparatus for use with first and second adjacent doors each adapted for independent movement between open and closed positions, said apparatus comprising latching means carried by said second door and selectively movable between latched and unlatched positions, said latching means, when in said latched position, preventing said second door from moving to its open position, a drive member connected to said latching means and operable when moved in one direction to a predetermined position to cause said latching means to move from said latched position to said unlatched position, a manually movable actuator member, a lost motion connection between said actuator member and said drive member, said lost motion connection permitting said actuator member to move through a predetermined distance without moving said drive member in said one direction and thereafter causing said actuator member to move said drive member in said one direction, a latch element carried by said first door and movable between latched and unlatched conditions, said latch element, when in said latched condition, engaging said second door and preventing said first door from moving to its open position, a sensor mounted to move along a predetermined path which intersects said latched element when said latch element is in said latched condition, said sensor normally being spaced along said path from said latch element, said actuator member being connected to said sensor and being operable to move said sensor along said path, said sensor engaging and stopping against said latch element when said sensor is moved along said path and when said first door is in its closed position and said latch element is in said latched condition, engagement of said sensor with said latch element stopping movement of said actuator member before said actuator member moves said drive member in said one direction to said predetermined position whereby said latching means is prevented from being moved to said unlatched position whenever said first door is in its closed position, said sensor, when said first door is in its open position, moving further along said path and permitting said actuator member to be moved sufficiently far to cause said drive member to move in said one direction to said predetermined position and thereby cause said latching means to move from said latched position to said unlatched position.

2. Apparatus as defined in claim 1 in which said drive member and said actuator member comprise a pair of face-to-face plates supported to turn about a common axis, said lost motion connection comprising an elongated slot formed in one of said plates and further comprising a pin attached to the other of said plates and received in said slot.

3. Apparatus as defined in claim 2 in which said slot is formed in the plate of said actuator member and is curved about said axis, said pin being attached to the plate of said drive member and being received in said slot with substantial angular clearance.

4. Apparatus as defined in claim 2 further including a spring biasing one of said plates to turn about said axis and causing one end of said slot to engage said pin when said latching means are in said latched position.

* * * * *

UNITED STATES PATENT AND TRADEMARK OFFICE

CERTIFICATE OF CORRECTION

PATENT NO. : 5,382,060

DATED : January 17, 1995

INVENTOR(S) : O'Toole et al.

It is certified that error appears in the above-indentified patent and that said Letters Patent is hereby corrected as shown below:

ON THE TITLE PAGE:

[73] ASSIGNEE:

Add -- Andersen Corporation, Bayport, Minnesota -- .

Signed and Sealed this

Nineteenth Day of September, 1995

*Attest:*

*Attesting Officer*

Bruce Lehman

BRUCE LEHMAN

*Commissioner of Patents and Trademarks*